US007445847B2

(12) United States Patent
Kulp

(10) Patent No.: US 7,445,847 B2
(45) **Date of Patent: *Nov. 4, 2008**

(54) CHEMICAL MECHANICAL POLISHING PAD

(75) Inventor: Mary Jo Kulp, Newark, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 215 days.

This patent is subject to a terminal disclaimer.

(21) Appl. No.: 11/442,077

(22) Filed: May 25, 2006

(65) Prior Publication Data

US 2007/0275226 A1 Nov. 29, 2007

(51) Int. Cl.
*B32B 27/00* (2006.01)
*B24D 11/00* (2006.01)

(52) U.S. Cl. ..... 428/423.1; 451/526; 451/527

(58) Field of Classification Search ..... None
See application file for complete search history.

(56) References Cited

U.S. PATENT DOCUMENTS 5,578,362 A 11/1996 Reinhardt et al.
5,814,409 A 9/1998 Hane et al.
6,022,268 A 2/2000 Roberts et al.
6,022,903 A 2/2000 Younes et al.
6,267,644 B1 7/2001 Molnar
6,454,634 B1 9/2002 James et al.
6,514,301 B1 2/2003 Lombardo
6,682,402 B1 1/2004 Roberts et al.
6,736,709 B1 5/2004 James et al.
6,860,802 B1 3/2005 Vishwanathan et al.
7,074,115 B2 7/2006 James et al.
7,169,030 B1 * 1/2007 Kulp ..... 451/527
2003/0148722 A1 8/2003 Lombardo et al.
2004/0198193 A1 10/2004 Tajima et al.
2005/0171225 A1 8/2005 Kulp

OTHER PUBLICATIONS

Szycher, Michael; Szycher's Handbook of Polyurethanes, 1999, pp. 11-1:11-23, CRC Press LLC, USA.

* cited by examiner

*Primary Examiner*—Sheeba Ahmed
(74) *Attorney, Agent, or Firm*—Blake T. Biederman

(57) ABSTRACT

The invention provides a polishing pad suitable for planarizing at least one of semiconductor, optical and magnetic substrates. The polishing pad includes a polymeric matrix having a top polishing surface. The top polishing surface has polymeric polishing asperities or forms polymeric polishing asperities upon conditioning with an abrasive. The polymeric polishing asperities are from a polymeric material having at least 45 weight percent hard segment and a bulk ultimate tensile strength of at least 6,500 psi (44.8 MPa). And the polymeric matrix has a two phase structure, a hard phase and a soft phase with an average area of the hard phase to average area of the soft phase ratio of less than 1.6.

10 Claims, 4 Drawing Sheets

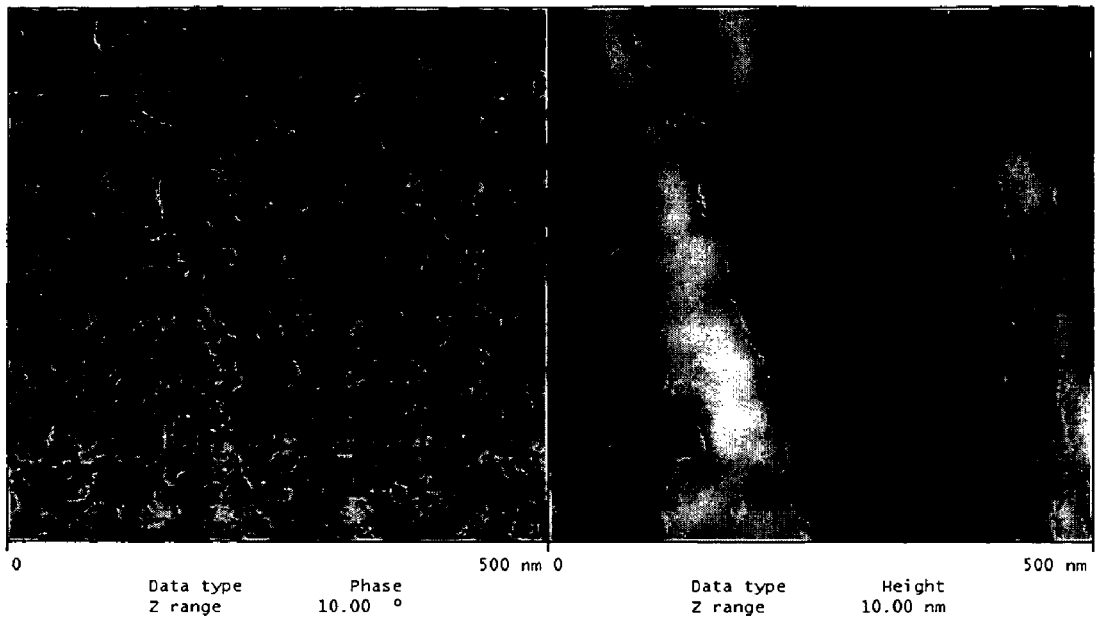
Figure 2a (Sample 1)
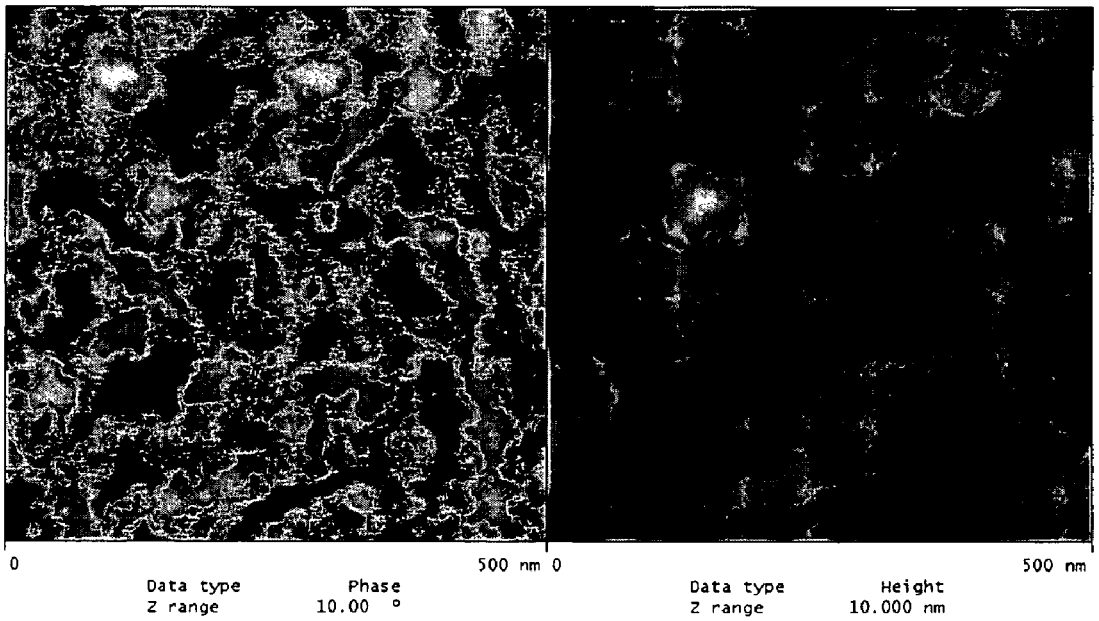
Figure 2b (Sample 2)

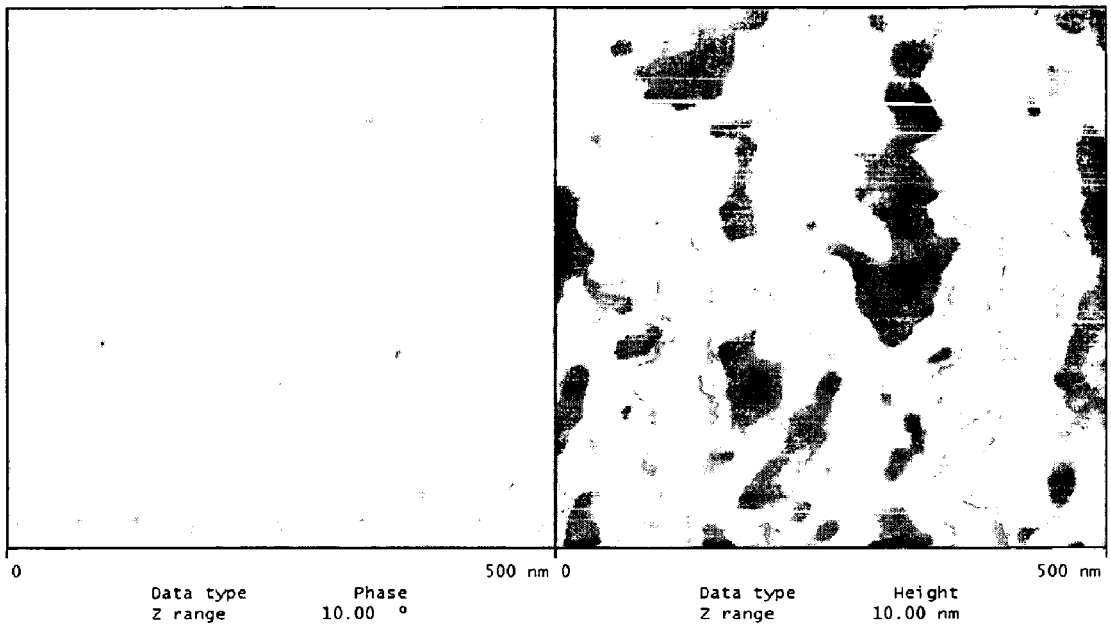
Figure 2c (Sample B)
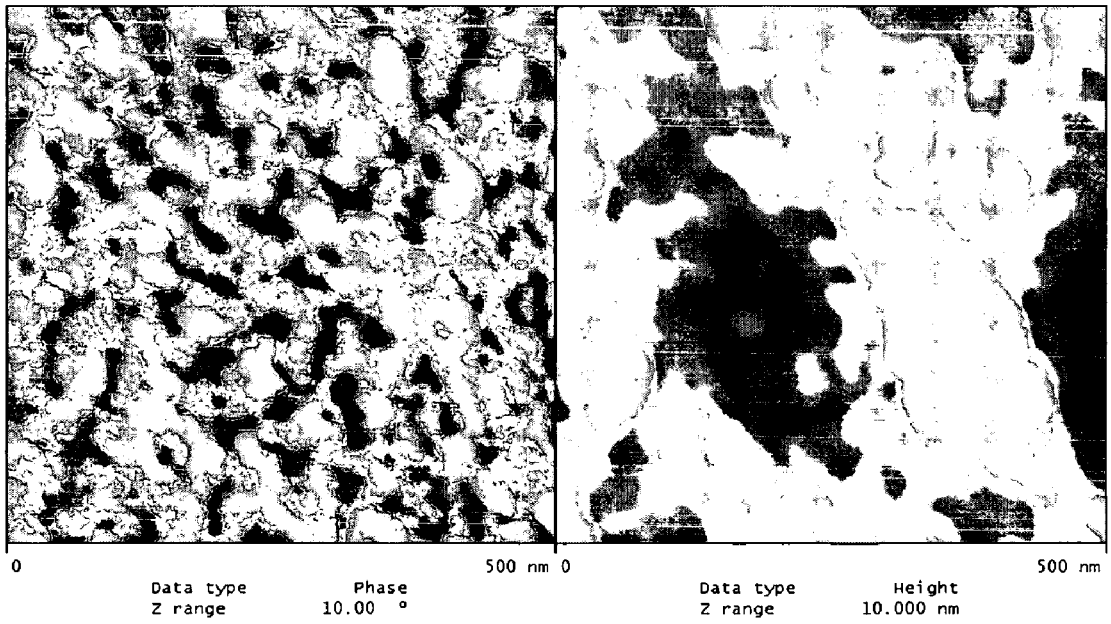
Figure 2d (Sample H)

CHEMICAL MECHANICAL POLISHING PAD

BACKGROUND

This specification relates to polishing pads useful for polishing and planarizing substrates, such as semiconductor substrates or magnetic disks.

Polymeric polishing pads, such as polyurethane, polyamide, polybutadiene and polyolefin polishing pads represent commercially available materials for substrate planarization in the rapidly evolving electronics industry. Electronics industry substrates requiring planarization include silicon wafers, patterned wafers, flat panel displays and magnetic storage disks. In addition to planarization, it is essential that the polishing pad not introduce excessive numbers of defects, such as scratches or other wafer non-uniformities. Furthermore, the continued advancement of the electronics industry is placing greater demands on the planarization and defectivity capabilities of polishing pads.

For example, the production of semiconductors typically involves several chemical mechanical planarization (CMP) processes. In each CMP process, a polishing pad in combination with a polishing solution, such as an abrasive-containing polishing slurry or an abrasive-free reactive liquid, removes excess material in a manner that planarizes or maintains flatness for receipt of a subsequent layer. The stacking of these layers combines in a manner that forms an integrated circuit. The fabrication of these semiconductor devices continues to become more complex due to requirements for devices with higher operating speeds, lower leakage currents and reduced power consumption. In terms of device architecture, this translates to finer feature geometries and increased numbers of metallization levels. These increasingly stringent device design requirements are driving the adoption of smaller and smaller line spacing with a corresponding increase in pattern density. The devices' smaller scale and increased complexity have led to greater demands on CMP consumables, such as polishing pads and polishing solutions. In addition, as integrated circuits' feature sizes decrease, CMP-induced defectivity, such as, scratching becomes a greater issue. Furthermore, integrated circuits' decreasing film thickness requires improvements in defectivity while simultaneously providing acceptable topography to a wafer substrate; these topography requirements demand increasingly stringent planarity, line dishing and small feature array erosion polishing specifications.

Historically, cast polyurethane polishing pads have provided the mechanical integrity and chemical resistance for most polishing operations used to fabricate integrated circuits. For example, polyurethane polishing pads have sufficient tensile strength for resisting tearing; abrasion resistance for avoiding wear problems during polishing; and stability for resisting attack by strong acidic and strong caustic polishing solutions. Unfortunately, the hard cast polyurethane polishing pads that tend to improve planarization, also tend to increase defects.

James et al., in US Pat. Pub. No. 2005/0079806, disclose a family of hard polyurethane polishing pads with planarization ability similar to IC1000™ polyurethane polishing pads, but with improved defectivity performance—IC1000 is a trademark of Rohm and Haas Company or its affiliates. Unfortunately, the polishing performance achieved with the polishing pad of James et al. varies with the polishing substrate and polishing conditions. For example, these polishing pads have limited advantage for polishing silicon oxide/silicon nitride applications, such as direct shallow trench isolation (STI) polishing applications. For purposes of this specification, silicon oxide refers to silicon oxide, silicon oxide compounds and doped silicon oxide formulations useful for forming dielectrics in semiconductor devices; and silicon nitride refers to silicon nitrides, silicon nitride compounds and doped silicon nitride formulations useful for semiconductor applications. These silicon compounds useful for creating semiconductor devices continue to evolve in different directions. Specific types of dielectric oxides in use include the following: TEOS formed from the decomposition of tetraethyloxysilicates, HDP ("high-density plasma") and SACVD ("sub-atmospheric chemical vapor deposition"). There is an ongoing need for additional polishing pads that have superior planarization ability in combination with improved defectivity performance. In particular, there is a desire for polishing pads suitable for polishing oxide/SiN with an improved combination of planarization and defectivity polishing performance.

STATEMENT OF INVENTION

An aspect of the invention provides a polishing pad suitable for planarizing at least one of semiconductor, optical and magnetic substrates, the polishing pad comprising a polymeric matrix, the polymeric matrix having a top polishing surface, the top polishing surface having polymeric polishing asperities or forming polymeric polishing asperities upon conditioning with an abrasive, the polymeric polishing asperities extending from the polymeric matrix and being a portion of the top polishing surface that can contact a substrate, the polishing pad forming additional polymeric polishing asperities from the polymeric matrix with wear or conditioning of the top polishing surface, and the polymeric polishing asperities being from a polymeric material having at least 45 weight percent hard segment and a bulk ultimate tensile strength of at least 6,500 psi (44.8 MPa) and the polymeric matrix having a two phase structure with a hard phase and a soft phase, the two pbase structure having an average area of the hard phase to average area of the soft phase ratio of less than 1.6.

Another aspect of the invention provides a polishing pad suitable for planarizing at least one of semiconductor, optical and magnetic substrates, the polishing pad comprising a polymeric matrix, the polymeric matrix having a top poJishing surface, the top polishing surface having polymeric polishing asperities or forming polymeric polishing asperities upon conditioning with an abrasive, the polymeric polishing asperities extending from the polymeric matrix and being a portion of the top polishing surface tbat can contact a substrate, the polishing pad forming additional polymeric polishing asperities from the polymeric matrix with wear or conditioning of the top polishing surface, polymeric matrix includes a polymer derived from difunctional or polyfunctional isocyanates and the polymeric polyurethane includes at least one selected from polyetherureas, polyisocyanurates, polyurethanes, poiyuxeas; polyurethaneureas, copolymers thereof and mixtures thereof, the polymeric polishing asperities being from a polymeric material having 50 to 80 weight percent hard segment and a bulk ultimate tensile strength of 6,500 to 14,000 psi (44.8 to 96.5 MPa) and the polymeric matrix having atwo phase structure, a hard phase and a soft phase, the two phase structure having an average area of the hard phase to average area of the soft phase ratio of less than 1.6.

In another aspect of the invention, the invention provides a polishing pad suitable for planarizin,g at least one of semiconductor, optical and magnetic substrates, the polishing pad comprising a. polymeric matrix, the polymeric matrix having a top polishing surface, the top polishing surface having polymeric polishing asperities or forming polymeric polishing asperities upon conditioning with an abrasive, the polymeric polishing asperities extending from the polymeric matrix and being the portion of the top polishing surface that can contact a substrate, the polymeric matrix containing at least 45 weight percent hard segment and a polymer containing at least one selected from polyetherureas, polyisocyanurates, polyurethanes, polyureas, polyurethaneureas, copolymers thereof and mixtures, the polymeric matrix having a two phase structure; the polymer being derived from difunctional or polyfunctional isocyanates and PTMEO or a PTMEG/PPG blend having 8.75 to 12 weight percent, stoichiometry of 97 to 125 percent.

DESCRIPTION OF THE DRAWING

FIGS. 2*a* to 2*d* represent AFM plots of samples 1, 2, B and H, respectively.

DETAILED DESCRIPTION

The invention provides a polishing pad suitable for planarizing at least one of semiconductor, optical and magnetic substrates, the polishing pad comprising a polymeric matrix. The polishing pads are particularly suitable for polishing and planarizing STI applications, such as HDP/SiN, TEOS/SiN or SACVD/SiN. The polishing pad's bulk material properties can have an unexpected benefit in both planarization and defectivity polishing performance. For purposes of this specification, the high tear strength of the bulk material represents the properties of the polymer without the deliberate addition of porosity, such as a non-porous polyurethane polymer. Historical understanding was that a material's compliance reduced scratching and facilitated low defectivity polishing, and that a material's stiffness or rigidity was critical to achieving excellent planarization behavior. In this invention, an increase in a polishing pad's bulk ultimate tensile strength in combination with its two-phase structure act in a manner that facilitates excellent polishing performance. In particular, the invention allows a blending of planarization and defectivity performance to achieve a range of polishing performance. In addition, these pads maintain their surface structure to facilitate eCMP ("electrochemical mechanical planarization") applications. For example, perforations through the pad, the introduction of conductive-lined grooves or the incorporation of a conductor, such as a conductive fiber or metal wire, can transform the pads into eCMP polishing pads.

Figure 1:
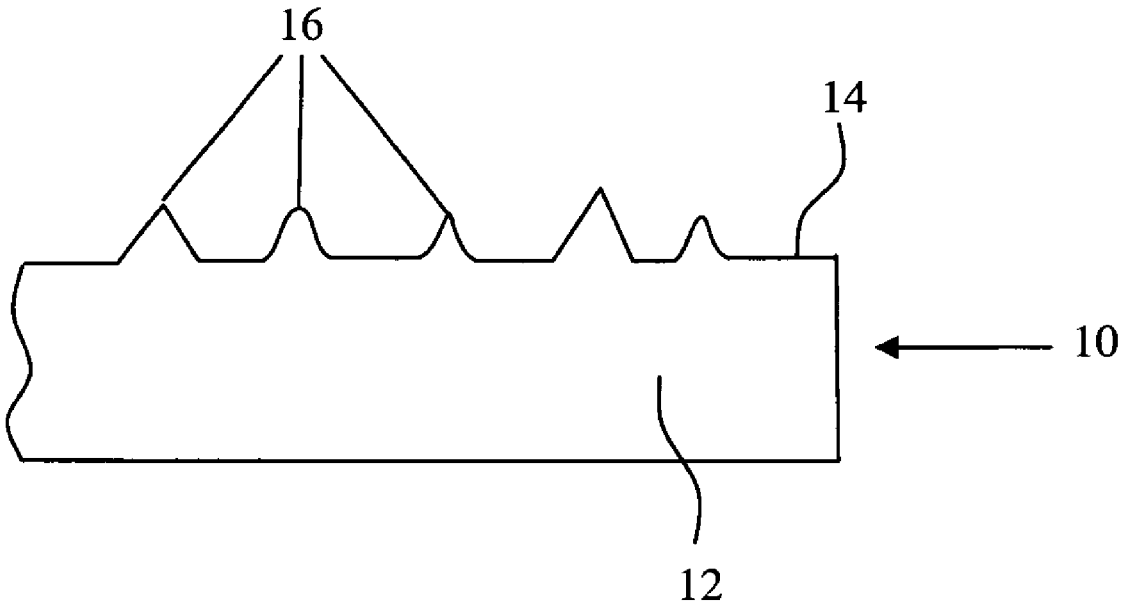
FIG. 1 represents a schematic cross-section illustrating asperities of a non-porous polishing pad.

Referring to FIG. 1, polymeric polishing pad 10 includes polymeric matrix 12 and top polishing surface 14. The polishing surface 14 includes a plurality of polymeric polishing asperities 16 or forms polymeric polishing asperities 16 upon conditioning with an abrasive for controlling wafer substrate removal rate of the polishing pad 10. For purposes of this specification, asperities represent structures that can contact or have a capability of contacting a substrate during polishing. Typically, conditioning with a hard surface, such as a diamond conditioning disk forms asperities on the pad surface during polishing. These asperities often form near the edge of a pore. Although conditioning can function in a periodic manner, such as for 30 seconds after each wafer or in a continuous manner, continuous conditioning provides the advantage of establishing steady-state polishing conditions for improved control of removal rate. The conditioning typically increases the polishing pad removal rate and prevents the decay in removal rate typically associated with the wear of a polishing pad. In addition to conditioning, grooves and perforations can provide further benefit to the distribution of slurry, polishing uniformity, debris removal and substrate removal rate.

The polymeric polishing asperities 16 extend from the polymeric matrix 12 and represent a portion of the top polishing surface 14 that contacts a substrate. The polymeric polishing asperities 16 are from a polymeric material having a high ultimate tensile strength and the polishing pad 10 forms additional polymeric polishing asperities 16 from the polymeric material with wear or conditioning of the top polishing surface 14.

The polymer matrices' ultimate tensile strength facilitates the silicon oxide removal rate, durability and planarization required for demanding polishing application. In particular, the matrices with high tensile strength tend to facilitate silicon oxide removal rate. The matrix preferably has a bulk ultimate tensile strength of at least 6,500 psi (44.8 MPa). More preferably, the polymer matrix has a bulk ultimate tensile strength of 6,500 to 14,000 psi (44.8 to 96.5 MPa). Most preferably, the polymeric matrix has a bulk ultimate tensile strength of 6,750 to 10,000 psi (46.5 to 68.9 MPa). Furthermore, polishing data indicate that a bulk ultimate tensile strength of 7,000 to 9,000 psi (48.2 to 62 MPa) is particularly useful for polishing wafers. The unfilled elongation at break is typically at least 200 percent and typically between 200 and 500 percent. The test method set forth in ASTM D412 (Version D412-02) is particularly useful for determining ultimate tensile strength and elongation at break.

In addition to ultimate tensile strength, bulk tear strength properties also contribute to the pad's polishing ability. For example, bulk tear strength properties of at least 250 lb/in. ($4.5\times10^3$ g/mm) are particularly useful. Preferably, the matrix has bulk tear strength properties of 250 to 750 lb/in. ($4.5\times10^3$ to $13.4\times10^3$ g/mm). Most preferably, the matrix has bulk tear strength properties of 275 to 700 lb/in. ($4.9\times10^3$ to $12.5\times10^3$ g/mm). The test method set forth in ASTM D1938 (Version D1938-02) using data analysis techniques outlined in ASTM D624-00e1 is particularly useful for determining bulk tear strength.

In addition to bulk tear strength, differential scanning calorimeter, ("DSC") data characterizing the heat of fusion of the hard segment can also useful for predicting polishing data. The heat of fusion of the hard segment, for purposes of this specification, represents the area below the baseline for the bulk or unfilled material. Typically, the DSC melting enthalpy is at least 25 J/g and most often in a range of 25 to 50 J/g.

Polyurethanes, and other block or segmented co-polymers having chain segments with limited miscibility, tend to separate into regions having properties that depend on the properties of each block or segment. The elastomeric behavior of such materials is attributed to this multiphase morphology which allows chain extension through reorganization in amorphous soft segment regions while ordered hard segments help the material retain its integrity.

This distinct hard-phase, soft-phase morphology can be visualized through tapping mode SPM, and thermal analysis can also indicate the degree of mixing of the phases. Where there is essentially no phase mixing, the copolymeric material will show clearly separated $T_g$s for each block that are consistent with those of the pure polymers. The degree of phase mixing can be quantified through use of the measured $T_g$ of the material combined with the $T_g$s of the pure materials. This allows the weight fraction of each polymer in the mixed region to be estimated through the Fox equation. Additionally, $T_m$s for materials are known to be depressed when they are less pure. In the case of polyurethanes or block co-polymers, purer hard phases are also an indirect indication that the soft phases are also purer.

The arrangement of these hard and soft segments into an overall material morphology depends on the amount of each block or segment in the system, with the larger volume of material generally acting as the continuous phase, while the smaller volume of material forms islands within that continuous phase. In pads of the current invention with high tensile strength, these materials contain at least 45 percent by weight hard segment. Example ranges include 50 to 80 weight percent hard segment and 55 to 65 weight percent hard segment. At this level of hard segment, the hard phase is generally continuous with some degree of soft phase mixed in. Harder materials tend to be better for planarizing in CMP processes than are soft materials, but they also tend to be more likely to produce scratches on wafers. For purposes of this specification, the amount (weight percent) of hard segment can be determined in a number of analytical ways, including various hardness testers, SAXS, SANS, SPM, DMA and DSC $T_m$ analysis, or through theoretical calculations from the starting materials. In practice, a combination of test methods can provide the most accurate value. In pads of the current invention, there are distinct soft-phase regions of large enough size within the mostly hard matrix, capable of deforming around a particle that could generate defects at the wafer surface.

In addition to the amount of hard segments, the ratio of distinct soft phase to distinct hard phase is also important for determining polishing performance. Interphase areas where hard and soft segments are more mixed as indicated by AFM were excluded from calculations for purposes of this specification. For example, soft phase adjacent the hard phase typically has a size wherein ratio of average size of the distinct hard phase to average area of the distinct soft phase is less than 1.6. For example, the ratio of average area of the hard phase to average area of the soft phase may be less than 1.5 or in a range of 0.75 to 1.5. In addition, the soft phase ideally has an average length of at least 40 nm. For example, typical average lengths ranges for the soft phase are 40 to 300 nm and 50 to 200 nm.

Typical polymeric polishing pad materials include polycarbonate, polysulphone, nylon, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. Preferably, the polymeric material is a polyurethane; and most preferably it is not a cross-linked polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Cast polyurethane polishing pads are suitable for planarizing semiconductor, optical and magnetic substrates. The pads' particular polishing properties arise in part from a prepolymer reaction product of a prepolymer polyol and a polyfunctional isocyanate. The prepolymer product is cured with a curative agent selected from the group comprising curative polyamines, curative polyols, curative alcohol amines and mixtures thereof to form a polishing pad. It has been discovered that controlling the ratio of the curative agent to the unreacted NCO in the prepolymer reaction product can improve porous pads' defectivity performance during polishing.

The polymer is effective for forming non-porous, porous and filled polishing pads. For purposes of this specification, fillers for polishing pads include solid particles that dislodge or dissolve during polishing, and liquid-filled particles or spheres. For purposes of this specification, porosity includes gas-filled particles, gas-filled spheres and voids formed from other means, such as mechanically frothing gas into a viscous system, injecting gas into the polyurethane melt, introducing gas in situ using a chemical reaction with gaseous product, or decreasing pressure to cause dissolved gas to form bubbles. The polishing pads contain a porosity or filler concentration of at least 0.1 volume percent. This porosity or filler contributes to the polishing pad's ability to transfer polishing fluids during polishing. Preferably, the polishing pad has a porosity or filler concentration of 0.2 to 70 volume percent. Most preferably, the polishing pad has a porosity or filler concentration of 0.3 to 65 volume percent. Preferably the pores or filler particles have a weight average diameter of 1 to 100 μm. Most preferably, the pores or filler particles have a weight average diameter of 10 to 90 μm. The nominal range of expanded hollow-polymeric microspheres' weight average diameters is 15 to 90 μm. Furthermore, a combination of high porosity with small pore size can have particular benefits in reducing defectivity. For example, a pore size of 2 to 50 μm constituting 25 to 65 volume percent of the polishing layer facilitates a reduction in defectivity. Furthermore, maintaining porosity between 40 and 60 percent can have a particular benefit to defectivity. Additionally, oxide:SiN selectivity is frequently adjustable by adjusting the level of porosity, with higher levels of porosity giving lower oxide selectivity.

Preferably, the polymeric material is a block or segemented copolymer capable of separating into phases rich in one or more blocks or segments of the copolymer. Most preferably the polymeric material is a polyurethane. For purposes of this specification, "polyurethanes" are products derived from difunctional or polyfunctional isocyanates, e.g. polyetherureas, polyesterureas, polyisocyanurates, polyurethanes, polyureas, polyurethaneureas, copolymers thereof and mixtures thereof. An approach for controlling a pad's polishing properties is to alter its chemical composition. In addition, the choice of raw materials and manufacturing process affects the polymer morphology and the final properties of the material used to make polishing pads.

Preferably, urethane production involves the preparation of an isocyanate-terminated urethane prepolymer from a polyfunctional aromatic isocyanate and a prepolymer polyol. For purposes of this specification, the term prepolymer polyol includes diols, polyols, polyol-diols, copolymers thereof and mixtures thereof. Preferably, the prepolymer polyol is selected from the group comprising polytetramethylene ether glycol [PTMEG], polypropylene ether glycol [PPG], ester-based polyols, such as ethylene or butylene adipates, copolymers thereof and mixtures thereof. Example polyfunctional aromatic isocyanates include 2,4-toluene diisocyanate, 2,6-toluene diisocyanate, 4,4'-diphenylmethane diisocyanate, naphthalene-1,5-diisocyanate, tolidine diisocyanate, para-phenylene diisocyanate, xylylene diisocyanate and mixtures thereof. The polyfunctional aromatic isocyanate contains less than 20 weight percent aliphatic isocyanates, such as 4,4'-dicyclohexylmethane diisocyanate, isophorone diisocyanate and cyclohexanediisocyanate. Preferably, the polyfunctional aromatic isocyanate contains less than 15 weight percent aliphatic isocyanates and more preferably, less than 12 weight percent aliphatic isocyanate.

Example prepolymer polyols include polyether polyols, such as, poly(oxytetramethylene)glycol, poly(oxypropylene) glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 8.0 to 15.0 wt. %. For polyurethanes formed with PTMEG or PTMEG blended with PPG, the preferable weight percent NCO is a range of 8.75 to 12.0; and most preferably it is 8.75 to 10.0. Particular examples of PTMEG family polyols are as follows: Terathane® 2900, 2000, 1800, 1400, 1000, 650 and 250 from Invista; Polymeg® 2900, 2000, 1000, 650 from Lyondell; PolyTHF® 650, 1000, 2000 from BASF, and lower molecular weight species such as 1,2-butanediol, 1,3-butanediol, and 1,4-butanediol. If the prepolymer polyol is a PPG, copolymer thereof or a mixture thereof, then the isocyanate-terminated reaction product most preferably has a weight percent unreacted NCO range of 7.9 to 15.0 wt. %. Particular examples of PPG polyols are as follows: Arcol® PPG-425, 725, 1000, 1025, 2000, 2025, 3025 and 4000 from Bayer; Voranol® 1010L, 2000L, and P400 from Dow; Desmophen® 1110BD, Acclaim® Polyol 12200, 8200, 6300, 4200, 2200 both product lines from Bayer If the prepolymer polyol is an ester, copolymer thereof or a mixture thereof, then the isocyanate-terminated reaction product most preferably has a weight percent unreacted NCO range of 6.5 to 13.0. Particular examples of ester polyols are as follows: Millester 1, 11, 2, 23, 132, 231, 272, 4, 5, 510, 51, 7, 8, 9, 10, 16, 253, from Polyurethane Specialties Company, Inc.; Desmophen® 1700, 1800, 2000, 2001KS, 2001K$^2$, 2500, 2501, 2505, 2601, PE65B from Bayer; Rucoflex S-1021-70, S-1043-46, S-1043-55 from Bayer.

Typically, the prepolymer reaction product is reacted or cured with a curative polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine. Optionally, it is possible to manufacture urethane polymers for polishing pads with a single mixing step that avoids the use of prepolymers.

The components of the polymer used to make the polishing pad are preferably chosen so that the resulting pad morphology is stable and easily reproducible. For example, when mixing 4,4'-methylene-bis-o-chloroaniline [MBCA] with diisocyanate to form polyurethane polymers, it is often advantageous to control levels of monoamine, diamine and triamine. Controlling the proportion of mono-, di- and triamines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

The polyurethane polymeric material is preferably formed from a prepolymer reaction product of toluene diisocyanate and polytetramethylene ether glycol with an aromatic diamine. Most preferably the aromatic diamine is 4,4'-methylene-bis-o-chloroaniline or 4,4'-methylene-bis-(3-chloro-2,6-diethylaniline). Preferably, the prepolymer reaction product has a 6.5 to 15.0 weight percent unreacted NCO. Examples of suitable prepolymers within this unreacted NCO range include: Airthane® prepolymers PET-70D, PHP-70D, PET-75D, PHP-75D, PPT-75D, PHP-80D manufactured by Air Products and Chemicals, Inc. and Adiprene® prepolymers, LFG740D, LF700D, LF750D, LF751D, LF753D, L325 manufactured by Chemtura. In addition, blends of other prepolymers besides those listed above could be used to reach to appropriate % unreacted NCO levels as a result of blending. Many of the above-listed prepolymers, such as, LFG740D, LF700D, LF750D, LF751D, and LF753D are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

In addition to controlling weight percent unreacted NCO, the curative and prepolymer reaction product typically has an OH or $NH_2$ to unreacted NCO stoichiometric ratio of 90 to 125 percent, preferably 97 to 125 percent; and most preferably, it has an OH or $NH_2$ to unreacted NCO stoichiometric ratio of greater than 100 to 120 percent. For example, polyurethanes formed with an unreacted NCO in a range of 101 to 115 percent appear to provide excellent results. This stoichiometry could be achieved either directly, by providing the stoichiometric levels of the raw materials, or indirectly by reacting some of the NCO with water either purposely or by exposure to adventitious moisture.

If the polishing pad is a polyurethane material, then the polishing pad preferably has a density of 0.4 to 1.3 g/cm$^3$. Most preferably, polyurethane polishing pads have a density of 0.5 to 1.25 g/cm$^3$.

EXAMPLES

Example 1

The polymeric pad materials were prepared by mixing various amounts of isocyanates as urethane prepolymers with 4,4'-methylene-bis-o-chloroaniline [MBCA] at 50° C. for the prepolymer and 116° C. for MBCA. In particular, various toluene diiosocyanate [TDI] with polytetramethylene ether glycol [PTMEG] prepolymers provided polishing pads with different properties. The urethane/polyfunctional amine mixture was mixed with the hollow polymeric microspheres (EXPANCEL® 551DE20d60 or 551DE40d42 manufactured by AkzoNobel) either before or after mixing the prepolymer with the chain extender. The microspheres had a weight average diameter of 15 to 50 μm, with a range of 5 to 200 μm, and were blended at approximately 3,600 rpm using a high shear mixer to evenly distribute the microspheres in the mixture. The final mixture was transferred to a mold and permitted to gel for about 15 minutes.

The mold was then placed in a curing oven and cured with a cycle as follows: thirty minutes ramped from ambient temperature to a set point of 104° C., fifteen and one half hours at 104° C. and two hours with a set point reduced to 21° C. The molded article was then "skived" into thin sheets and macro-channels or grooves were machined into the surface at room temperature—skiving at higher temperatures may improve surface roughness. As shown in the Tables, samples 1 to 3 represent polishing pads of the invention and samples A to J represent comparative examples.

TABLE 1

| Formulation | Prepolymer % NCO | Curative:NCO ratio | Pore level, wt. % Expancel 551DE20d60 Microspheres | Elongation at break, % ASTM D412-02 | Solvent (NMP) Swelling ASTM F2214-02 |
|---|---|---|---|---|---|
| 1-1 | 8.75-9.05 | 105 | 3.21 | 90 | 1.92 |
| 1-2 | 8.75-9.05 | 105 | 2.14 | 145 | 2.12 |
| 1-3 | 8.75-9.05 | 105 | 1.07 | 210 | 2.32 |
| A-1 | 8.75-9.05 | 95 | 3.21 | 100 | 1.61 |
| A-2 | 8.75-9.05 | 95 | 2.14 | 130 | 1.61 |
| A-3 | 8.75-9.05 | 95 | 1.07 | 180 | 1.64 |
| B-1 | 8.75-9.05 | 85 | 3.21 | 75 | 1.56 |
| B-2 | 8.75-9.05 | 85 | 2.14 | 95 | 1.55 |
| B-3 | 8.75-9.05 | 85 | 1.07 | 130 | 1.59 |

All samples contained Adiprene™ LF750D urethane prepolymer from Chemtura—the formulation contains a blend of TDI and PTMEG. Conditioning pad samples by placing them in 50% relative humidity for five days at 25° C. before testing improved the repeatability of the tensile tests.

Table 1 illustrates the elongation at break of polyurethanes cast with different stoichiometric ratios and varied amounts of polymeric microspheres. The different stoichiometric ratios control the amount of the polyurethane's crosslinking. Furthermore, increasing the quantity of polymeric microspheres generally decreases physical properties, but improves polishing defectivity performance. The resulting elongation at break property of the filled materials does not appear to represent a clear indicator of polishing performance. Sample swelling in n-methyl-pyrrolidone values indicated that that the degree of swelling is an indicator of a formulation's polishing performance. Formulations with swelling values greater than or equal to 1.67 (ratio of the diameter of the swollen material over the initial diameter) provide improved polishing results (and material can in fact dissolve). Sample swelling values that were too low were a strong indicator that the formulations would have poor polishing performance. Samples that dissolved in the n-methyl-pyrrolidone, however, provided both acceptable and unacceptable polishing results—not a clear indicator of polishing results.

Table 2 below provides a series of polyurethanes cast with various amounts of NCO at 85, 95 and 105% stiochiometries.

TABLE 2

| Sample | Prepolymer | Prepolymer wt % NCO | Curative:NCO ratio | Wt % Microspheres |
|---|---|---|---|---|
| 1 | LF750D | 8.75-9.05 | 105 | 0 |
| 2 | LF751D | 8.9-9.2 | 105 | 0 |
| 3 | LF753D | 8.45-8.75 | 105 | 0 |
| A | LF750D | 8.75-9.05 | 95 | 0 |
| B | LF750D | 8.75-9.05 | 85 | 0 |
| A' | LF750D | 8.75-9.05 | 95 | 0 |
| C | L325 | 8.95-9.25 | 85 | 0 |
| C' | L325 | 8.95-9.25 | 85 | 0 |
| D | LF600D | 7.1-7.4 | 95 | 0 |
| E | LF950A | 5.9-6.2 | 95 | 0 |
| F | LF751D | 8.9-9.2 | 95 | 0 |
| G | LF753D | 8.45-8.75 | 95 | 0 |
| H | LF751D | 8.9-9.2 | 85 | 0 |
| I | LF753D | 8.45-8.75 | 85 | 0 |
| J | L325 | 8.95-9.25 | 95 | 0 |

Samples contained Adiprene™ LF600D, LF750D, LF751D, LF753D, LF950A urethane TDI-PTMEG prepolymer from Chemtura or Adiprene L325$H_{12}$MDI/TDI-PTMEG prepolymer from Chemtura. DMA data implied that some samples may have contained small amounts of PPG as well as PTMEG.

Prepolymer was heated under a nitrogen gas blanket to lower viscosity and then hand mixed with MBCA at the desired curative:NCO ratio and degassed. Samples were then hand cast as 1/16" (1.6 mm) thick plaques. Cast material was then held in an oven for 16 hours at 100° C. to complete the cure. Trouser tear samples were cast directly into a mold rather than cut with a die, and were somewhat thicker than stipulated by ASTM D1938-02.

Example 2

FIGS. 2A to 2D illustrate four samples of polyurethane imaged using SPM techniques. These techniques were modified to amplify the differences in different regions of the samples based on their hardness, allowing the hard and soft phases to be imaged. To carry out the experiment an FESP tip with a low spring constant was used to give additional sensitivity. All sampling parameters were kept constant during the experiment for all samples analyzed. A setpoint ratio of 0.8 was chosen to collect the images. The two images for each sample show the sample phase distribution on the left and the corresponding topography for that same region on the right.

FIGS. 2A and 2B (Samples 1 and 2) correspond to polyurethanes having distinct two phase structure of hard phase and soft phase, with ratio of purest hard phase to purest soft phase<1.6. FIG. 2*c* (Sample B) lacks a distinct two-phase structure. FIG. 2*d* (Sample H) lacks sufficient purest soft phase relative to the amount of purest hard phase necessary for increasing tear strength.

Areas defined by the lightest light for the purest hard phases and the darkest dark for the purest soft phases were measured to the nearest 1/16" in each direction from FIGS. 2*a* to 2*d*. [Regions with mixed hard and soft segments, as shown by shade of gray between the extremes of light and dark, were excluded from the measurements and calculations.] Measurements were then converted to nanometers using the conversion factor 1/16"=12.5 nm. The short and long dimensions were multiplied by each other to approximate the area of purest hard and purest soft phases. Tables 3A to 3D, correspond to FIGS. 2A to 2D respectively.

TABLE 3A

| Sample 1 hard long | Sample 1 hard short | Sample 1 soft long | Sample 1 soft short | Sample 1 area hard | Sample 1 area soft |
|---|---|---|---|---|---|
| 25 | 25 | 25 | 25 | 625 | 625 |
| 25 | 25 | 37.5 | 25 | 625 | 937.5 |
| 37.5 | 37.5 | 37.5 | 25 | 1406.25 | 937.5 |
| 62.5 | 50 | 50 | 25 | 3125 | 1250 |
| 50 | 37.5 | 62.5 | 25 | 1875 | 1562.5 |
| 37.5 | 25 | 75 | 25 | 937.5 | 1875 |
| 50 | 25 | 37.5 | 12.5 | 1250 | 468.75 |
| 50 | 25 | 50 | 12.5 | 1250 | 625 |
| 87.5 | 37.5 | 62.5 | 12.5 | 3281.25 | 781.25 |
| 87.5 | 37.5 | 62.5 | 12.5 | 3281.25 | 781.25 |
| 62.5 | 25 | 62.5 | 12.5 | 1562.5 | 781.25 |
| 50 | 12.5 | 75 | 12.5 | 625 | 937.5 |
| 50 | 12.5 | 87.5 | 12.5 | 625 | 1093.75 |
| 75 | 12.5 | 87.5 | 12.5 | 937.5 | 1093.75 |
| | | | Totals | 21406.25 | 13750 |

TABLE 3B

| Sample 2 hard long | Sample 2 hard short | Sample 2 soft long | Sample 2 soft short | Sample 2 area hard | Sample 2 area soft |
|---|---|---|---|---|---|
| 37.5 | 37.5 | 62.5 | 62.5 | 1406.25 | 3906.25 |
| 87.5 | 75 | 62.5 | 50 | 6562.5 | 3125 |
| 62.5 | 50 | 50 | 37.5 | 3125 | 1875 |
| 62.5 | 50 | 125 | 75 | 3125 | 9375 |
| 75 | 50 | 50 | 25 | 3750 | 1250 |
| 75 | 50 | 87.5 | 37.5 | 3750 | 3281.25 |
| 100 | 62.5 | 87.5 | 37.5 | 6250 | 3281.25 |
| 62.5 | 37.5 | 125 | 50 | 2343.75 | 6250 |
| 87.5 | 37.5 | 62.5 | 25 | 3281.25 | 1562.5 |
| 87.5 | 37.5 | 62.5 | 25 | 3281.25 | 1562.5 |
| 100 | 37.5 | 125 | 37.5 | 3750 | 4687.5 |
| 75 | 25 | 112.5 | 25 | 1875 | 2812.5 |
| 125 | 37.5 | 100 | 12.5 | 4687.5 | 1250 |
| 100 | 25 | 175 | 12.5 | 2500 | 2187.5 |
| 125 | 25 | 50 | 37.5 | 3125 | 1875 |
| | | | Totals | 52812.5 | 48281.25 |

TABLE 3C

| Sample B hard long | Sample B hard short | Sample B soft long | Sample B soft short | Sample B area hard | Sample B area soft |
|---|---|---|---|---|---|
| 25 | 25 | 25 | 12.5 | 625 | 312.5 |
| 37.5 | 12.5 | 25 | 12.5 | 468.75 | 312.5 |
| 25 | 12.5 | 25 | 12.5 | 312.5 | 312.5 |
| 25 | 12.5 | 25 | 12.5 | 312.5 | 312.5 |
| 62.5 | 37.5 | 50 | 12.5 | 2343.75 | 625 |
| 37.5 | 37.5 | 25 | 12.5 | 1406.25 | 312.5 |
| 12.5 | 12.5 | 37.5 | 12.5 | 156.25 | 468.75 |
| 50 | 12.5 | 25 | 12.5 | 625 | 312.5 |
| 50 | 25 | 12.5 | 12.5 | 1250 | 156.25 |
| 75 | 25 | 25 | 12.5 | 1875 | 312.5 |
| 25 | 25 | 25 | 12.5 | 625 | 312.5 |
| 37.5 | 12.5 | 25 | 12.5 | 468.75 | 312.5 |
| 50 | 25 | 25 | 12.5 | 1250 | 312.5 |
| 25 | 25 | 25 | 12.5 | 625 | 312.5 |
| | | | Totals | 12343.75 | 4687.5 |

TABLE 3D

| Sample H hard long | Sample H hard short | Sample H soft long | Sample H soft short | Sample H area hard | Sample H area soft |
|---|---|---|---|---|---|
| 112.5 | 100 | 62.5 | 62.5 | 11250 | 3906.25 |
| 100 | 87.5 | 50 | 37.5 | 8750 | 1875 |
| 75 | 62.5 | 37.5 | 25 | 4687.5 | 937.5 |
| 75 | 62.5 | 62.5 | 37.5 | 4687.5 | 2343.75 |
| 62.5 | 50 | 25 | 12.5 | 3125 | 312.5 |
| 37.5 | 25 | 75 | 25 | 937.5 | 1875 |
| 62.5 | 37.5 | 75 | 25 | 2343.75 | 1875 |
| 62.5 | 25 | 112.5 | 37.5 | 1562.5 | 4218.75 |
| 62.5 | 25 | 100 | 25 | 1562.5 | 2500 |
| 62.5 | 25 | 112.5 | 25 | 1562.5 | 2812.5 |
| 100 | 37.5 | 112.5 | 25 | 3750 | 2812.5 |
| 75 | 25 | 87.5 | 12.5 | 1875 | 1093.75 |
| 125 | 37.5 | 50 | 25 | 4687.5 | 1250 |
| 100 | 12.5 | 100 | 25 | 1250 | 2500 |
| | | | Totals | 52031.25 | 30312.5 |

The values were then summed for each sample and the ratio of the sum of purest hard phase to the sum of purest soft phase was determined in Table 3E.

TABLE 3E

| | Sample 1 | Sample 2 | Sample B | Sample H |
|---|---|---|---|---|
| Area Ratio Hard/Soft | 1.56 | 1.09 | 2.63 | 1.72 |

For samples of the invention, the area ratio of the sum of the purest hard phase to the sum of the purest soft phase was <1.6.

TABLE 4

| Sample | Prepolymer | Stoichiometry | Sample Name | $T_m$, peak T ° C. | Heat of fusion J/g | Calculated % hard segment | J/calculated g hard segment |
|---|---|---|---|---|---|---|---|
| B | LF750D | 85 | 24A u | 227.57 | 23.87 | 56.7 | 42.1 |
| B | LF750D | 85 | 24A u | 227.28 | 24.73 | 56.7 | 43.6 |
| B | LF750D | 85 | 24A u | 227.51 | 25.15 | 56.7 | 44.3 |
| 1 | LF750D | 105 | 24B u | 231.31 | 31.57 | 59.8 | 52.8 |
| 1 | LF750D | 105 | 24B u | 233.03 | 29.43 | 59.8 | 49.2 |
| 1 | LF750D | 105 | 24B u | 231.6 | 30.29 | 59.8 | 50.7 |
| H | LF751D | 85 | 24C u | 238.1 | 25.69 | 57.4 | 44.8 |
| H | LF751D | 85 | 24C u | 237.9 | 28.11 | 57.4 | 49.0 |
| H | LF751D | 85 | 24C u | 237.83 | 28.21 | 57.4 | 49.2 |
| 2 | LF751D | 105 | 24D u | 241.37 | 32.6 | 60.4 | 54.0 |
| 2 | LF751D | 105 | 24D u | 241.22 | 35.82 | 60.4 | 59.3 |
| 2 | LF751D | 105 | 24D u | 240.85 | 35.61 | 60.4 | 58.9 |
| I | LF753D | 85 | 24E u | 228.52 | 22.84 | 55.4 | 41.2 |
| I | LF753D | 85 | 24E u | 229.42 | 17.37 | 55.4 | 31.4 |
| I | LF753D | 85 | 24E u | 228.54 | 23.16 | 55.4 | 41.8 |
| 3 | LF753D | 105 | 24F u | 233.35 | 25.6 | 58.5 | 43.8 |
| 3 | LF753D | 105 | 24F u | 236.3 | 28.77 | 58.5 | 49.2 |
| 3 | LF753D | 105 | 24F u | 232.73 | 30.13 | 58.5 | 51.5 |
| B | LF750D | 85 | 24A c | 227.86 | 23.78 | 56.7 | 41.9 |
| B | LF750D | 85 | 24A c | 227.17 | 23.79 | 56.7 | 41.9 |
| B | LF750D | 85 | 24A c | 227.56 | 23.87 | 56.7 | 42.1 |
| 1 | LF750D | 105 | 24B c | 231.38 | 29.75 | 59.8 | 49.8 |
| 1 | LF750D | 105 | 24B c | 231.9 | 30.98 | 59.8 | 51.8 |
| 1 | LF750D | 105 | 24B c | 231.55 | 32.12 | 59.8 | 53.7 |
| H | LF751D | 85 | 24C c | 238.19 | 28.7 | 57.4 | 50.0 |
| H | LF751D | 85 | 24C c | 239.24 | 26.54 | 57.4 | 46.2 |
| H | LF751D | 85 | 24C c | 240.59 | 28.37 | 57.4 | 49.4 |
| 2 | LF751D | 105 | 24D c | 240.93 | 34.07 | 60.4 | 56.4 |
| 2 | LF751D | 105 | 24D c | 241.21 | 33.2 | 60.4 | 55.0 |
| 2 | LF751D | 105 | 24D c | 239.58 | 28.77 | 60.4 | 47.6 |
| I | LF753D | 85 | 24E c | 228.15 | 23.84 | 55.4 | 43.0 |
| I | LF753D | 85 | 24E c | 227.57 | 22.73 | 55.4 | 41.0 |
| I | LF753D | 85 | 24E c | 228.35 | 24.26 | 55.4 | 43.8 |
| 3 | LF753D | 105 | 24F c | 232.71 | 27.97 | 58.5 | 47.8 |
| 3 | LF753D | 105 | 24F c | 232.82 | 29.98 | 58.5 | 51.3 |
| 3 | LF753D | 105 | 24F c | 232.62 | 28.94 | 58.5 | 49.5 |

Table 4 shows the peak melting temperature of the hard segment, the heat of fusion in J/g of material, the calculated hard segment percentage and the calculated J/g of hard segment. Samples were analyzed on a TA Instruments Q1000 V9.4 DSC using the Standard Cell with an initial equilibration at −90° C., held isothermally for 5 minutes followed by a 10° C./minute ramp from −90 to 300° C. One set of samples was tested as-prepared, while the other set of samples was held in the temperature/humidity chamber for 5 days prior to testing.

Samples of the invention show higher peak melting temperatures and higher heats of fusion in J/g of sample, as well as higher heats of fusion in J/calculated gram of hard segment. Both the higher peak melting temperature and the higher heat of fusion are indicators of higher hard phase purity; by analogy, the soft segment regions can also be expected to be purer and of greater size.

Figure 3:
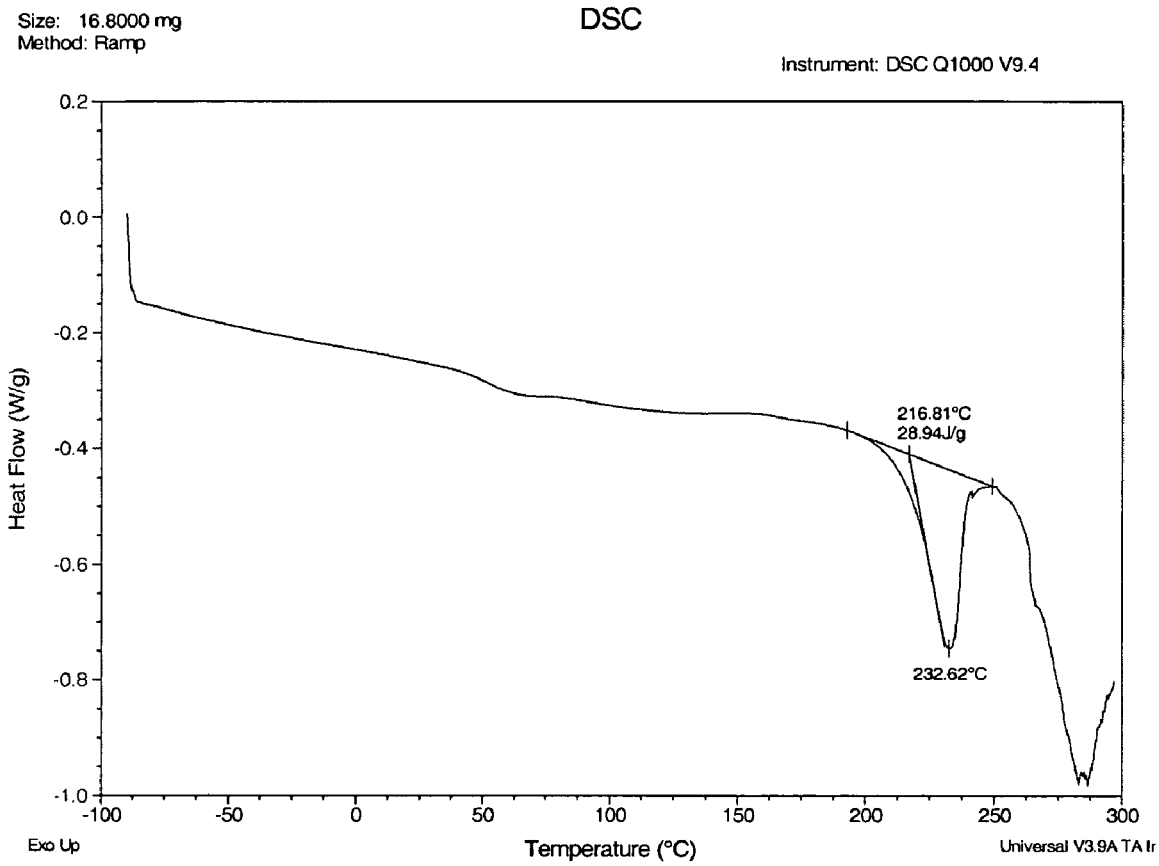
FIG. 3 illustrates the test method for determining DSC data.

FIG. 3 illustrates the test method for calculating DSC $T_m$ and heat of fusion data. "Peak" area was calculated using TA Instruments Universal Analysis 2000, with the linear baseline fit for the peak integration algorithm. Endpoints were inserted manually in relatively straight areas on either side of the "peak," with the lower limit near 185° C. and the upper limit near 240° C. "Peak" maximum, and "peak" area values were then calculated by the software.

Table 5 shows the tensile and tear properties of unfilled, bulk elastomers made from various Adiprene polyurethane prepolymers and MBCA. As with the filled materials, the elongation at break is not a clear indicator of polishing performance. The tear strength, however, does correlate to low defectivity polishing performance, with high tear strength giving low defectivity.

TABLE 5

| Sample | Curative:NCO ratio | Tensile strength at break, psi/MPa ASTM D412-02 | Median Elongation at break--unfilled polymer, % ASTM D412-02 | Avg. Tear strength, lb/in- (g/mm × $10^3$) ASTM D1938-02 D624-00e1 | Avg. Tear strength, lb/in- (g/mm × $10^3$) ASTM D470 |
|---|---|---|---|---|---|
| 1 | 105 | 7120/49 | 313 | 297 (5.5) | |
| 2 | 105 | 7413/51 | 328 | 336 (6.0) | |
| 3 | 105 | 7187/50 | 303 | 312 (5.6) | |
| A | 95 | 7100*/49* | 230* | | 140* (2.5) |

TABLE 5-continued

| Sample | Curative:NCO ratio | Tensile strength at break, psi/MPa ASTM D412-02 | Median Elongation at break--unfilled polymer, % ASTM D412-02 | Avg. Tear strength, lb/in- (g/mm × $10^3$) ASTM D1938-02 D624-00e1 | Avg. Tear strength, lb/in- (g/mm × $10^3$) ASTM D470 |
|---|---|---|---|---|---|
| B | 85 | 7617/52 | 192 | 146 (2.6) | |
| A' | 95 | 6930/48 | 217 | | |
| C | 85 | 8603/59 | 292 | | |
| C' | 85 | 9468/65 | 320 | | |
| D | 95 | 6700*/46* | 290* | | 115* (2.0) |
| E | 95 | 5500*/38* | 350* | | 125* (2.2) |
| F | 95 | 7500*/52* | 230* | | 145* (2.6) |
| G | 95 | 7500*/52* | 230* | | 130* (2.3) |
| H | 85 | 8111/56 | 235 | 189 (3.4) | |
| I | 85 | 7252/50 | 210 | 159 (2.8) | |
| J | 95 | 8800*/61* | 260* | | 112* (2.0) |

*Indicates values are from Chemtura literature

Example 3

Pads of 80 mil (2.0 mm) thickness and 22.5 inch (57 cm) diameter were cut from cakes prepared with the process of Example 1. The pads included a circular groove pattern of 20 mil (0.51 mm) width, 30 mil (0.76 mm) depth and 70 mil (1.8 mm) pitch with an SP2150 polyurethane subpad. Polishing with a SpeedFam-IPEC 472 tool on platen 1 at 5 psi (34.5 KPa), 75 rpm platen speed and 50 rpm carrier speed provided comparative polishing data for the different pads. The polishing also relied upon a Kinik CG181060 diamond conditioner. The test wafers include TEOS sheet wafers, silicon nitride sheet wafers and 1 HDP MIT pattern wafer for measuring planarization of Celexis™ CX2000A ceria-containing slurry from Rohm and Haas Electronic Materials CMP Technologies.

Table 6 shows the formulations with their stoichiometric ratios of chain extender to isocyanate, pore size and level, and the resulting densities and Shore D hardnesses. The small and medium-sized pores were added at different weight levels to achieve the same volume loading as shown by the calculated pore volumes and the measured formulation densities.

Table 7 includes the Opti-Probe 2600 metrology data for TEOS and SiN removal rates generated after polishing the wafers with the experimental pad formulations and Celexis™ CX2000 on platen 1 followed by a buffing step on platen two with a Politex™ polyurethane poromeric polishing pad from Rohm and Haas Electronic Materials CMP Inc. Chatter marks and scratches were quantified using the Compass™ 300 with SEMVision™ G2 review after HF etching wafers to remove approximately 500 Å of SiN from the wafer surface which removes ceria particle contamination and "decorates" defects to make them more obvious.

TABLE 6

| Formulation Designation | Stoichiometry | Pore Size | Pore Level g/100 g formulation | Pore Level, Added vol., cc/100 g formulation | Density, g/cc | Shore D Hardness* |
|---|---|---|---|---|---|---|
| B-1 | 85 | small | 3.21 | 54 | 0.697 | 50.4 |
| B-3 | 85 | small | 1.07 | 18 | 0.952 | 61.8 |
| B-3 | 85 | medium | 0.75 | 18 | 0.967 | 60.3 |
| B-1 | 85 | medium | 2.25 | 54 | 0.689 | 49.2 |
| A-2 | 95 | medium | 1.5 | 36 | 0.829 | 55.7 |
| A-2 | 95 | small | 2.14 | 36 | 0.642 | 43.5 |
| A-1 | 95 | small | 3.21 | 54 | 0.764 | 52.9 |
| A-3 | 95 | medium | 0.75 | 18 | 0.977 | 60.5 |
| A-3 | 95 | small | 1.07 | 18 | 0.983 | 61.9 |
| A-1 | 95 | medium | 2.25 | 54 | 0.676 | 48.0 |
| B-2 | 85 | small | 2.14 | 36 | 0.828 | 57.1 |
| B-2 | 85 | medium | 1.5 | 36 | 0.827 | 54.9 |
| 1-1 | 105 | small | 3.21 | 54 | 0.580 | 45.0 |
| 1-2 | 105 | small | 2.14 | 36 | 0.780 | 49.0 |
| 1-3 | 105 | small | 1.07 | 18 | 0.960 | 60.0 |
| 1-1 | 105 | medium | 2.25 | 54 | 0.610 | 42.0 |
| 1-2 | 105 | medium | 1.5 | 36 | 0.810 | 54.0 |
| 1-3 | 105 | medium | 0.75 | 18 | 0.960 | 59.0 |
| IC1000 A2 | 87 | medium | 1.6 | 38 | 0.800 | 55.0 |

Conditioning pad samples by placing them in 50% relative humidity for five days at 25° C. before testing and stacking six 50-mil (1.3 mm) samples improved the repeatability of the Shore D hardness tests using ASTM D2240-05 and density by ASTM 1622-03.

TABLE 7

| Formulation Designation | Avg_TEOS RR | Avg SiN | Chattermarks, scratches | Selectivity, TEOS/SiN |
|---|---|---|---|---|
| B-1 | 5883 | 376 | 35.8 | 15.7 |
| B-3 | 5421 | 442 | 59.9 | 12.3 |
| B-3 | 5140 | 522 | 53.0 | 9.8 |
| B-1 | 5689 | 361 | 48.0 | 15.8 |
| A-2 | 6008 | 613 | 53.0 | 9.8 |
| A-2 | 6189 | 529 | 54.8 | 11.7 |
| A-1 | 6402 | 675 | 61.0 | 9.5 |
| A-3 | 5823 | 957 | 151.8 | 6.1 |
| A-3 | 5346 | 230 | 11 | 23.2 |
| A-1 | 6043 | 428 | 135.7 | 14.1 |
| B-2 | 5904 | 430 | 373.0 | 13.7 |
| B-2 | 5543 | 369 | 73.5 | 15.0 |
| 1-1 | 7309 | 1496 | 33.0 | 4.9 |
| 1-2 | 6903 | 610 | 19.0 | 11.3 |
| 1-3 | 6082 | 284 | 0.7 | 21.4 |
| 1-1 | 6819 | 683 | 126.0 | 10.0 |
| 1-2 | 6676 | 576 | 86.0 | 11.6 |
| 1-3 | 6225 | 266 | 2.0 | 23.4 |
| IC1000 A2 | 6005 | 296 | 100.0 | 20.3 |

These data illustrate much lower defectivity levels are possible with the high tear strength polishing pads of the invention. This result is especially pronounced with formulations using the small pores. In addition, a broad range of TEOS/SiN selectivities is achievable with pads of this invention.

The invention claimed is:

1. A polishing pad suitable for planarizing at least one of semiconductor, optical and magnetic substrates, the polishing pad comprising a polymeric matrix, the polymeric matrix having a top polishing surface, the top polishing surface having polymeric polishing asperities or forming polymeric polishing asperities upon conditioning with an abrasive, the polymeric polishing asperities extending from the polymeric matrix and being a portion of the top polishing surface that can contact a substrate, the polishing pad forming additional polymeric polishing asperities from the polymeric matrix with wear or conditioning of the top polishing surface, and the polymeric polishing asperities being from a polymeric material having at least 45 weight percent hard segment and a bulk ultimate tensile strength of at least 6,500 psi (44.8 MPa) and the polymeric matrix having a two phase structure, a hard phase and a soft phase, the two phase structure having an average area of the hard phase to average area of the soft phase ratio of less than 1.6.

2. The polishing pad of claim 1 wherein the polymeric matrix has 50 to 80 weight percent hard segment.

3. The polishing pad of claim 1 wherein the polymeric matrix includes a polymer derived from difunctional or polyfunctional isocyanates and the polymeric polyurethane includes at least one selected from polyetherureas, polyisocyanurates, polyurethanes, polyureas, polyurethaneureas, copolymers thereof and mixtures thereof.

4. The polishing pad of claim 3 wherein the polymeric matrix is from the reaction product of a curative agent and an isocyanate-terminated polymer, the curative agent contains curative amines that cure the isocyanate-terminated reaction product and the isocyanate-terminated reaction product has an $NH_2$ to NCO stoichiometric ratio of greater than 100 to 125 percent.

5. The polishing pad of claim 1 wherein the soft phase has an average length measured in cross section of at least 40 nm.

6. A polishing pad suitable for planarizing at least one of semiconductor, optical and magnetic substrates, the polishing pad comprising a polymeric matrix, the polymeric matrix having a top polishing surface, the top polishing surface having polymeric polishing asperities or forming polymeric polishing asperities upon conditioning with an abrasive, the polymeric polishing asperities extending from the polymeric matrix and being a portion of the top polishing surface that can contact a substrate, the polishing pad forming additional polymeric polishing asperities from the polymeric matrix with wear or conditioning of the top polishing surface, the polymeric matrix includes a polymer derived from difunctional or polyfunctional isocyanates and the polymeric polyurethane includes at least one selected from polyetherureas, polyisocyanurates, polyurethanes, polyureas, polyurethaneureas, copolymers thereof and mixtures thereof, the polymeric polishing asperities being from a polymeric material having 50 to 80 weight percent hard segment and a bulk ultimate tensile strength of 6,500 to 14,000 psi (44.8 to 96.5 MPa) and the polymeric matrix having a two phase structure, a hard phase and a soft phase, the two phase structure having an average area of the hard phase to average area of the soft phase ratio of less than 1.6.

7. The polishing pad of claim 6 wherein the heat of fusion is 25 to 50 J/g.

8. A polishing pad suitable for planarizing at least one of semiconductor, optical and magnetic substrates, the polishing pad comprising a polymeric matrix, the polymeric matrix having a top polishing surface, the top polishing surface having polymeric polishing asperities or forming polymeric polishing asperities upon conditioning with an abrasive, the polymeric polishing asperities extending from the polymeric matrix and being the portion of the top polishing surface that can contact a substrate, the polymeric matrix containing at least 45 weight percent hard segment and a polymer containing at least one selected from polyetherureas, polyisocyanurates, polyurethanes, polyureas, polyurethaneureas, copolymers thereof and mixtures, the polymeric matrix having a two phase structure; the polymer being derived from difunctional or polyfunctional isocyanates and PTMEG or a PTMEG/PPG blend having 8.75 to 12 weight percent unreacted NCO with a stoichiometric ratio of OH or $NH_2$ to NCO of 97 to 125 percent.

9. The polishing pad of claim 8 wherein the polymeric matrix has a DSC heat of fusion of at least 25 J/g.

10. The polishing pad of claim 8 including porosity of 25 to 65 volume percent within the polymer matrix and an average pore diameter of 2 to 50 μm.

* * * * *